United States Patent [19]

Whelan

[11] Patent Number: 4,964,561

[45] Date of Patent: Oct. 23, 1990

[54] SELF-LOCKING CARTON

[75] Inventor: Harry I. Whelan, Colonial Heights, Va.

[73] Assignee: Inland Container Corporation, Indianapolis, Ind.

[21] Appl. No.: 365,081

[22] Filed: Jun. 12, 1989

[51] Int. Cl.[5] ..... B65D 43/16

[52] U.S. Cl. ..... 229/102; 206/807; 229/149; 229/177

[58] Field of Search ..... 206/807; 229/102, 145, 229/149, 177, 179

[56] References Cited

U.S. PATENT DOCUMENTS

| | | | |
|---|---|---|---|
| 2,373,977 | 4/1945 | Scherer | 229/145 |
| 2,515,327 | 7/1950 | Bergstein | 229/149 |
| 2,531,507 | 11/1950 | Goodyear | 229/145 |
| 2,777,629 | 1/1957 | Osteen | 229/145 |
| 2,839,236 | 6/1958 | Dunning | 229/145 |
| 2,957,617 | 10/1960 | Bolding | 229/145 |
| 2,961,144 | 11/1960 | Anderson, Jr. | 229/102 |
| 3,512,699 | 5/1970 | Wilson | 229/102 |
| 3,543,995 | 12/1970 | Wilson | 229/149 |
| 3,642,193 | 2/1972 | Rada | 229/149 |
| 4,252,267 | 2/1981 | Osborne | 229/149 |

FOREIGN PATENT DOCUMENTS

| | | | |
|---|---|---|---|
| 574285 | 4/1959 | Canada | 229/145 |

*Primary Examiner*—Gary E. Elkins

*Attorney, Agent, or Firm*—Fitch, Even, Tabin & Flannery

[57] ABSTRACT

A carton having interfitting cover and bottom portions is formed from an integral blank and has improved automatic locking features. Locking tabs struck out from an endwall of the cover are received in recesses formed in an endwall of the bottom portion. The locking tabs are wedged by folded end flaps to insure proper orientation for reception in the recesses, and to provide a bias force to urge the locking tabs into engagement with wall portions surrounding the recesses.

5 Claims, 2 Drawing Sheets

SELF-LOCKING CARTON

BACKGROUND OF THE INVENTION

1. Field of the Invention

The present invention pertains to cartons having interfitting cover and bottom portions and in particular to such cartons having an interlocking to prevent or resist separation of the carton portions.

2. Description of the Related Art

Self-locking cartons have been provided in the past to meet a variety of needs. For example, self-locking cartons, having locking cover and bottom portions, are less likely to open unintentionally during shipping, thereby compromising their contents. Further, the locking feature of the carton prevents pilfering or other unauthorized entry into the carton to obtain access to its contents.

To be commercially practical, a self-locking carton should be economical to manufacture, with little or no additional costs in either labor of manufacture or assembly, or in the price or number of components required to produce the locking feature. Further, the self-locking carton should be easy to operate, preferably having an automatic locking engagement.

The following are examples of cartons having locking or coupling features and to which certain improvements, such as those outlined above, can be made. For example, U.S. Pat. No. 2,961,144 discloses a pilfer-proof box consisting of two completely separate, interfitting portions. An upwardly bent tab on the cover portion slides over an outwardly bent tab on the bottom portion of the box, thus providing an interlocking engagement between the two tabs preventing the interfitting box portions from being telescopically separated.

U.S. Pat. No. 2,963,210 has two completely separate interfitting cover and container portions. The cover has an inwardly directed tab received in an aperture formed in the sidewall of the container bottom portion, which restricts separation of the container portions.

U.S. Pat. No. 2,939,624 also has inwardly bent tabs in a cover portion of a container which are received in apertures formed in the sidewalls of a bottom portion of the container. The tabs, when received in the sidewalls prevent telescopic removal of the two container components which, as in the above examples, are separate one from another.

As a further example of this type of coupling arrangement, U.S. Pat. No. 3,734,392 provides a container having separate cover and bottom portions with a locking tab inwardly projecting from the cover and received in an aperture formed in the box sidewall.

The following four U.S. Patents: U.S. Pat. Nos. 2,963,210; 2,939,624; 3,734,392 and 2,961,144 each provide containers having separate but interfittable cover and bottom portions. The cover portions contain an inwardly directed tab received in an aperture of the sidewall of the container bottom portions. When the tab is received in the apertured sidewall, telescopic separation of the cover and bottom portions is prevented.

U.S. Pat. No. 3,713,579 provides a container with a pair of opposed hinged lids, which is suitable for use as a grape lug. Endwalls of the carton bottom portion have upstanding lugs with inwardly facing recesses. Locking tabs carried on the hinged lids are bent in an upward direction and when swung to a closed position are received in the lug recesses to provide a locking feature.

U.S. Pat. Nos. 3,342,401 and 4,717,070 disclose two-part containers with completely separate cover and bottom portions. Tabs on the cover portion are folded or bent so as to protrude into apertures formed in the sidewalls of the bottom portions, thus providing a coupling between the two container portions.

U.S. Pat. Nos. 2,827,222, 3,342,401 and 4,717,070 disclose two-part containers having telescopically interfitting cover and bottom portions.

U.S. Pat. No. 4,076,168 discloses a two-part carton for food products having a variety of interfitting coupling arrangements. For example, button-shaped tabs carried on the cover portion are received in slots formed in the bottom portion sidewalls. In another embodiment, the bottom portion of the container has an outturned rim folded against the sidewall. The cover portion extends below the rim and has an upwardly projecting edge received in the overturned rim portion. In a further embodiment, outwardly directed hook members are received in apertures formed at the lower portions of the container cover and are snapped together to provide a coupling.

U.S. Pat. No. 3,809,305 provides a two-part container having separate cover and bottom portions. The bottom portion has outwardly directed bulging sections which are open or slotted at this bottom end. Inwardly directed tabs carried on an interfitting cover portion are received in the bulging portions of the carton bottom and extend through the open bottom end thereof to provide an inter-coupling.

SUMMARY OF THE INVENTION

It is an object according to the present invention to provide a container having interfitting cover and bottom portions with an automatic self-locking feature locking the portions together.

Another object according to the present invention is to provide a container of the above-described type wherein the cover and bottom portions are hingedly interconnected and are formed from a single, unitary blank.

A further object according to the present invention is to provide a container of the above-described type with inwardly directed tabs received in apertures of the container bottom portion.

Yet another object according to the present invention is to provide a carton of the type described immediately above and further having means for insuring the proper outward deflection of the locking tabs.

These and other objects according to the present invention, which will become apparent from studying the appended description and drawings are provided in a carton assembly, comprising:

- a cover member including an inner, hinge mounting end and an opposed outer end with a downwardly depending outer endwall;
- a receptacle member interfittable with the cover member including an inner, hinge mounting end and an opposed outer end with an upstanding outer endwall;
- hinge means joining the inner ends of the cover and receptacle members so as to bring the cover and receptacle member outer endwalls immediately adjacent one another when the cover and receptacle members are interfitted one in the other;

a lock tab upwardly and inwardly extending from the cover outer endwall;

a recess on the receptacle outer endwall for receiving at least a portion of the lock tab when the cover and receptacle members are interfitted; and aligning means associated with the cover member for aligning the lock tab for reception in the recess when the cover and receptacle members are interfitted.

BRIEF DESCRIPTION OF THE DRAWINGS

In the drawings, wherein like elements are referenced alike.

DETAILED DESCRIPTION OF THE PREFERRED EMBODIMENT

Figure 1:
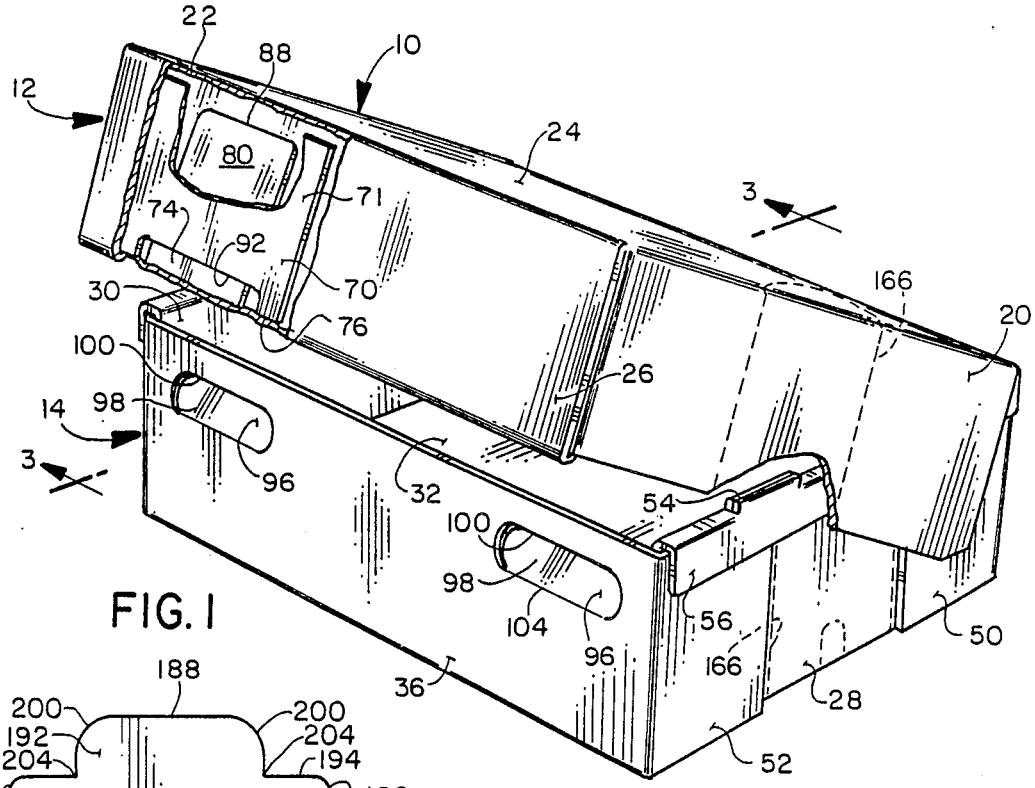
FIG. 1 is a perspective view of a carton illustrating aspects according to the present invention.

Referring now to the drawings and initially to FIG. 1, a carton illustrating aspects according to the present invention is generally indicated at 10. The carton 10 includes a cover or lid 12 and a receptacle member or bottom 14. A carton constructed according to the present invention provides an improved, reliable locking of the lid and bottom portions and can thereby be relied upon to assure the quality of the contents stored therein.

In the preferred embodiment, carton 10 is constructed from a unitary blank generally indicated at 16. The blank 16 may be made of suitable material such as single or double-faced cardboard, pressboard, or the like paper product. Blank 16 could also be made from non-paper material such as a plastic.

As will be seen later, carton 10 is formed by simple bending and folding of blank 16. This method of construction, wherein a fully formed carton is produced from a flat blank has proven to be very economical in both material and fabrication costs. Other advantages are also realized. For example, a number of blanks 16 can be formed ahead of time, and conveniently stored on a pallet or skid near a manufacturing site. On demand, a requisite number of cartons can be readily assembled from the carton blanks. For example, the carton blanks can be located near the end of an assembly line for products which require a secure containment prior to shipping or storage.

Referring again to the figures, lid 12 includes an endwall 26 extending between the side panels 20, 22 and downwardly extending from an outer edge of a top wall or cover panel 24. As will be seen, the opposed inner edge of top wall panel 24 is connected to the carton bottom 14 along a hinge line.

The carton bottom 14 includes sidewalls 28, 30 upwardly extending from opposed ends of a floor panel 32. Carton bottom 14 further includes inner and outer opposed endwalls 34, 36. The sidewalls 28, 30 and endwalls 34, 36 cooperate with floor panel 32 to form a tray-like receptacle having an open upper end for receiving contents to be stored in the carton.

As will be seen later with reference to FIG. 2, the inner endwall 34 of carton bottom 14 and the inner, hinge mounting end 25 of cover panel 24 preferably comprise adjacent portions of the same sheet-like blank. The blank is preferably folded along a hinge line 40 so as to join the inner ends of the carton cover and bottom members.

As illustrated in the figures, the carton bottom is dimensioned smaller than the cover so as to be interfittable therewithin. Due to the hinge construction at the inner ends of the carton cover and bottom, interfitting is accomplished by swinging the outer end of the cover over the outer end of the carton bottom. As seen in FIGS. 3–6, the lower edge 42 of the cover outside endwall 26 clears the upper edge 44 of the outside endwall 36 of carton bottom 14 with a very substantial gap or spacing 46. Thus, the cover endwall is swung about an arc as the cover is lowered into the closed position of FIGS. 4 and 7.

Figure 7:
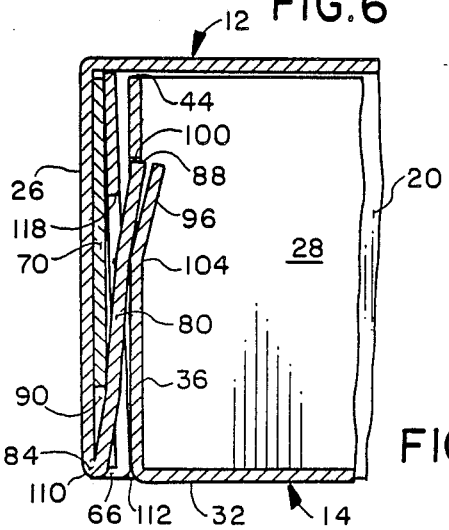
FIG. 7 is similar to FIG. 6, but shows the carton lid in a fully closed position.

Because the lower edge 42 of the cover endwall must clear the upper edge 44 of the bottom outer endwall 36, the endwalls 26, 36 are spaced a greater distance apart than that which is possible with a two-part box which, at least theoretically, can be dimensioned for a close fit engagement between the various sidewalls and endwalls of the separate cover and bottom members. Referring briefly to FIG. 7, the various layers of the cover endwall 26 are spaced from the bottom endwall 36, particularly at the upper edge 44 thereof. As will be seen herein, the present invention provides a positive locking of the cover and bottom members of the carton despite the aforementioned necessary spacing which arises from the hinged inner connection and the preferred construction of carton 10. Locking tabs, as will be seen, extend from the lower edge 42 of the cover endwall 26 and, according to other aspects of the present invention, are provided with an assured bias toward the bottom endwall 36 to aid in providing an assured positive interlocking.

Most of the carton bottom 14 has a relatively simple, single-layer construction throughout the major portions of its upstanding sidewalls. The exceptions to this are noted with reference to FIG. 1 wherein end flaps 50, 52 extend from the bottom endwalls 34, 36 to overlie the bottom sidewall 28. Upstanding tabs 54 extend from the end panels 50, 52. A downturned flap 56 extends from the upper edge of sidewall 28 and is folded over the end panels 50, 52. Flap 56 is slotted to receive the upstanding tabs 54 to provide an interlocking of the sidewalls and endwalls of the carton bottom 14.

The carton cover 12 also has relatively simple, single ply sidewalls 20, 22 and a cover panel 24. However, the endwall 26 at the outer edge of cover 12 has a relatively complicated assembly, and at portions thereof has multiple overlapping layers to provide numerous advantages. The reference numeral 26 has been applied to describe the cover endwall which includes not only an outer, exposed end panel 60 continuously formed with cover panel 24, but further includes the underlying layers as well, as will now be seen.

The cover end panel 26 includes an interior flap 64 extending from the exposed panel 60 and joined thereto with a fold or bend line 66 at the bottom edge of the endwall. The interior flap 64 has a free end 66 which preferably fits snugly against the interior surface 68 of cover panel 24.

End flaps 70 extend from the sidewalls 20, 22 and are folded so as to partially overlie the exposed panel 60 of the cover endwall. The interior flap 64 is preferably folded over the bottom edges of end flaps 70 so as to trap the end flaps 70 between the interior flap 64 and the exposed end panel 60. As can be seen in FIG. 1, a recess 74 extends from the bottom edge 76 of end flaps 70.

According to one feature of the present invention, locking tabs 80 are struck out from interior flap 64. The locking tabs have a lower end 82 hingedly connected to the exposed end panel 60 by a hinge line 84. The locking tabs 80 also include an upper free end 86 which includes an exposed locking edge 88 (see FIGS. 3, 5 and 6). As can be seen from the cutaway portion of FIG. 1, the locking tabs 80 are aligned with the recesses 74 which extend from the bottom edge 76 of end flap 70.

Figure 5:
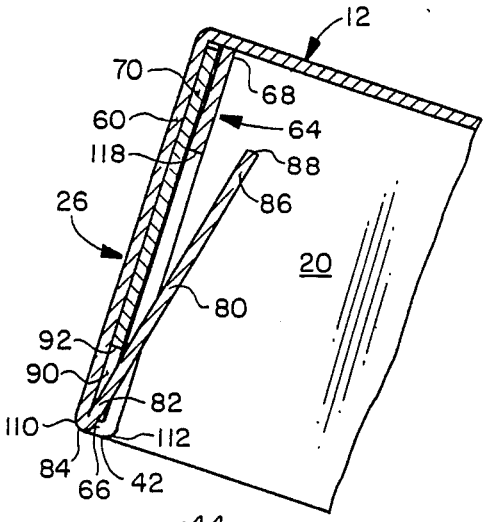
FIG. 5 is a fragmentary exploded view showing the left-hand portion of FIG. 3 in greater detail.
Figure 5:
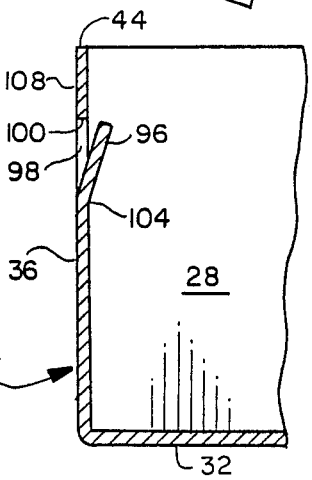
Figure 6:
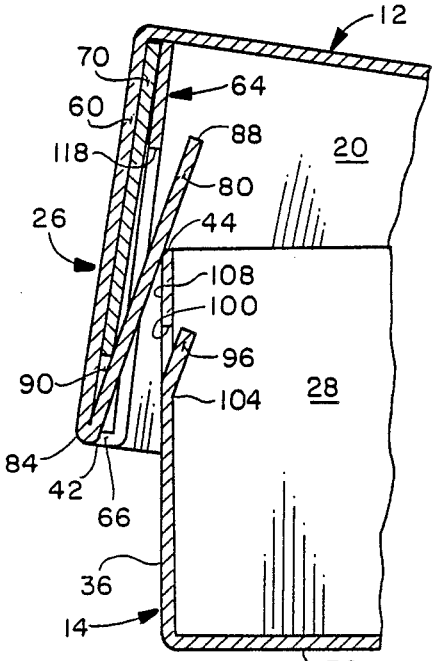
FIG. 6 is an exploded fragmentary cross-sectional view similar to that of FIG. 5, but showing the carton lid in a partially lowered position.

With reference to the enlarged views of FIGS. 5–7, the hinge connection 66 of interior flap 64 and exposed panel 60 preferably includes a pair of spaced parallel fold lines 110, 112 whereas the hinge 84 joining the locking flap 80 to the exposed panel 60 is folded at a single fold line 110. Hence, the hinge 66 is considerably wider than the minimally dimensioned hinge 84.

Several advantages are attained from this construction. Referring, for example, to FIGS. 5 and 6 it can be seen that the hinge 84 lies slightly to the outside of end tab 70, so that a triangular shaped opening 90 is formed with respect to the interior edge 92. The interior edge 92, which is formed by recess 74, wedges locking tab 80 away from the exposed end panel 60. According to one aspect of the present invention, when locking tab 80 is pressed into contact with end tab 70, and in particular the interior edge 92 thereof, an accurately defined acute angle is defined between the locking tab and the exposed end panel 60.

According to another aspect of the present invention, the height of locking tab 80 can be carefully controlled by controlling the distance between hinge line 84 and the locking edge 88. Accordingly, the position of locking edge 88 is accurately fixed in spacial location and, owing to the wedging action of interior edge 92, is biased away from the exposed end panel 60. The aforementioned wedging action provides a resilient bias, preventing collapse of the locking tab against remaining portions of endwall 26.

The carton bottom 14 as mentioned above has an outside endwall 36 located adjacent the cover endwall 26 when the carton is in a closed configuration. As can be seen in FIG. 1, a pair of tabs 96 are upwardly and inwardly struck from outside endwall 36 so as to form recesses 98 therein. Interior edges 100 are formed at the upper ends of recesses 98. With the carton in a fully closed position, such as that illustrated in FIG. 7, the free ends 86 of locking tabs 80 are received in recesses 98 with the locking edges 88 in abutting engagement with the interior edges 100 of the outside endwall 36, thus locking cover 12 in a closed position. In this manner, a substantial retaining ability is provided as compressive forces are applied to the locking tab and outside endwalls.

As will now be appreciated, it is important that the locking edge 88 of the locking tab and the interior edge of the outside endwall 36 be aligned in abutting engagement if a maximum retaining force is to be realized. To some extent, the height of tabs 96, that is, the distance separating the interior edge 100 from the hinge connection 104 of tab 96 is important. As can be seen in FIG. 7, contact of locking tab 80 to the outside endwall 36 adjacent the hinge line 104 can be relied upon as an optional aid in guiding the locking edge 88 into the desired abutting alignment with interior edge 100. According to other aspects of the present invention, the desired abutting alignment is further assured by the angular disposition of locking tab 80 relative to the exposed end panel 60.

According to other principles of the present invention, the desired position of locking tab 80 is quickly and automatically attained upon lowering of cover 12 into the closed position. With reference to FIGS. 5–7, and turning initially to FIG. 5, locking tab 80 is initially struck out from remaining portions of endwall 26. Upon lowering of cover 12 toward a closed position, such as that illustrated in FIG. 6, the locking tab 80 is brought into contact with the upper edge 44 of the carton bottom outside endwall 36. If the locking tab is not previously in engagement with the interior edge 92 of end flap 70, it is quickly brought into contact therewith as the locking tab slides across the free edge 44 of the bottom endwall. It is important to note that the wedging contact is assured, despite a sizeable spacing between the outside endwalls of the cover and bottom members.

As cover 12 is continued to be swung in a downward direction, the locking edge 88 wipes across the outside surface portion 108 at the upper end of outer endwall 36. In the preferred embodiment, as locking edge 88 wipes across surface 108, the locking tab is slightly bent due to the wedging action of interior edge 92. This slight bending readily provides a resilient bias force, even in materials usually thought of as being fairly rigid. For example, a substantial bias force can be developed in single or double-faced cardboard material, in many grades of stiff paperboard material and also in plastics and some metal materials. This developed bias force urges locking tab 80 into recess 98 as soon as the locking edge 88 passes the interior edge 100 of endwall 36. At this point, the locking tab snaps into engagement with endwall 36 adjacent the hinge line 104 and the aforementioned desired abutting relationship between the locking tab and the locking edge 100 formed in the interior of endwall 36 is quickly and reliably attained. With the fully closed configuration of FIG. 7, stored energy in the locking tab maintains the desired abutting alignment thus assuring a maximum retention or locking force at all times.

As will now be appreciated, especially by those skilled in the art, the development of a bias force, and an aligning of the locking tab and locking edge formed in the interior of the bottom endwall can be reliably attained even for substantial spacings between the carton and bottom endwalls, including spacings greater than that illustrated in the figures. Thus, increased clearances between the cover endwall and the carton bottom endwall such as those associated with cartons of increased depth, can be accommodated without comprising the aforementioned locking retention.

As can now be appreciated, in the preferred embodiment, the bias force of locking tab 80 is developed, in part, because of the lateral offset or displacement of hinge line 84 toward the outer surface 71 of end flap 70, that surface made visible in FIG. 1 by the broken-away portion of cover endwall 26. Other advantages are also attained by this lateral offset. As was explained above, the locking tab 80 is preferably resiliently bent at the point of contact with the interior edge 92 of end flap 70. A certain amount of resilience will be lost should the locking tab become bent or kinked at this point of contact. The lateral offset of hinge line 84 from the outer surface 71 of end flap 70 provides an additional assurance that the locking edge 88 of the locking tab will be brought into abutting engagement with interior edge 100. As was explained above, the locking tab 80 is preferably struck out from the interior flap 64 and, without special precautions, the locking tab would be freely recessable into the remaining portion of the interior flap as the original coplanar alignment therewith is reinstated.

However, according to one aspect of the present invention, the hinge 42 for joining the interior flap 64 to the exposed endwall 60 is formed by parallel spaced apart fold lines 110, 112 (see FIG. 5 for example) and thus the bottom edge 42 of endwall 26 has a substantial thickness, such that the interior flap 64 is spaced apart from the exposed end panel 60 at the bottom portion thereof. The hinge 42, in cross-section, is generally U-shaped owing to the spaced-apart fold lines 110, 112 and is distinguished from the generally V-shaped cross-section of hinge 84 joining locking tab 80 to the exposed endwall 60. This causes the locking edge 88 of locking tab 80 to extend beyond the interior edge 118 of flap 64 (see FIGS. 5–7), even when folded thereagainst, so that the free end 86 of the locking tab partially overlies the upper portion of interior flap 64 from which it is struck.

Owing to the lateral offset of hinge line 84, contact of locking tab 80 with the interior edge 118 of the interior flap results in an upward and inward angular deflection of the locking tab relative to the exposed endwall 60, even despite any kinking or bending of the locking tab that may occur at the point of contact with interior edge 92. Even if the locking tab 80 looses all resilience because of such kinking, the angular offset at the point of contact of locking tab 80 with interior edge 118 assures that the locking edge 88 will be disposed thereabove so as to be brought into the desired upward and inward orientation so as to assure abutting alignment with the locking edge 100 of the carton bottom 14.

If desired, the carton cover can be designed such that contact of the locking tab with the interior edge 118 occurs simultaneously with the resilient bending of locking tab 80 at the interior edge 92, and the guiding contact of the locking tab with the endwall adjacent hinge line 104. Alternatively, the cover can be dimensioned such that the upper free end 86 of the locking tab is slightly spaced from the interior edge 118 when the carton is in a fully closed position.

As seen above, the interior edge 92 of end flap 70 serves as a spacer means preventing the folding of locking tab 80 upon the cover endwall. If desired, the spacer means can be provided by a shim or the like adhesively secured to the bottom of the locking tab, adjacent the hinged connection to the endwall outer panel. Other spacer arrangements, contemplated by the present invention, carried on the locking tab will occur to those skilled in the art.

Figure 2:
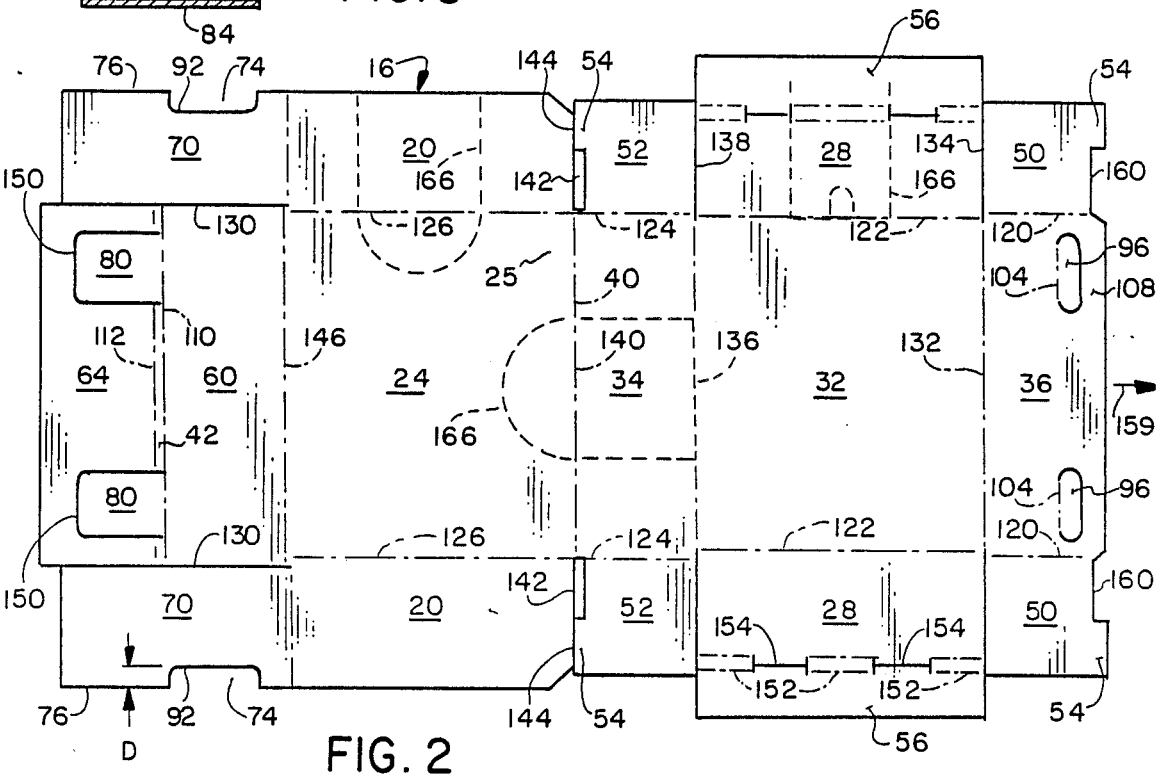
FIG. 2 is a plan view of a blank from which the carton of FIG. 1 is formed.
Figure 3:
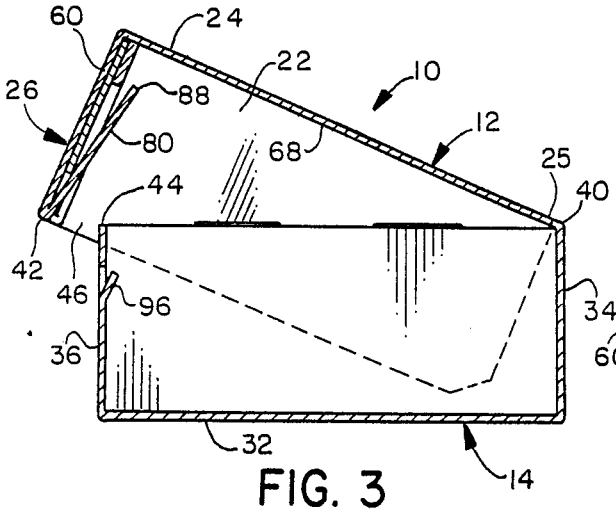
FIG. 3 is a cross-sectional view of the carton of FIG. 1.
Figure 4:
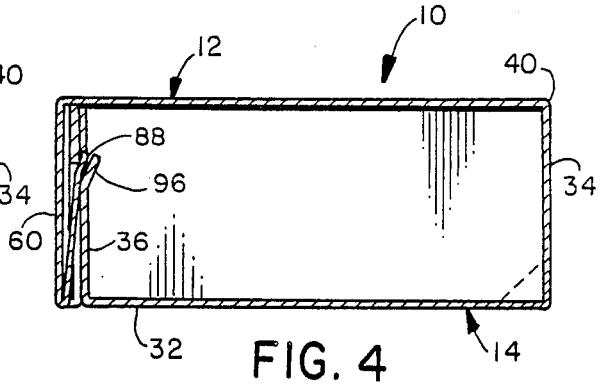
FIG. 4 is a cross-sectional view similar to that of FIG. 3, but showing the carton in a fully closed position.

Referring now to FIG. 2, additional features and advantages of the present invention will be described with reference to the carton blank 16 which, as mentioned above, is preferably formed from unitary sheet material. Looking along the longitudinal axis of the blank 16, and assuming the machine direction extends in the direction of arrow 159, the outside endwall is formed at the leading end of the carton blank. Following the outside endwall 36 is the floor panel 32, inner endwall 34, cover panel 24, exposed end panel 60 and interior flap 64. Score lines, such as the score lines 120 are illustrated in dot-dash. Score lines 120 separate the outside endwall 36 from the carton bottom end panels 50. Score lines 122 separate the floor panel 32 from carton bottom sidewall panels 28. Similarly, score lines 124 separate inner end wall 34 from end panels 52. Scores lines 126, substantially colinearly aligned with the aforementioned score lines 120, 122 and 124, separate the cover panel 24 from sidewalls 20. Cut lines 130, substantially colinearly aligned with the aforementioned score lines separate the exposed end panel 60 and interior flap 64 from end flaps 70.

Transverse score lines which will now be described give the aforedescribed endwalls and panels separate identity while uniting those members together in a unitary construction. For example, transverse score line 132 separates floor panel 32 from outside endwall 36. Cut lines 134 substantially colinear with score line 132 separate the sidewalls 28 from end panels 50. Transverse score line 136 separates the floor panel 32 from the inner endwall 34. Cut lines 138 generally colinear with the aforementioned score line 136 separates the sidewalls 28 from end panels 52. Score line 140 is formed at the juncture of inner endwall 34 and cover panel 24.

Generally rectangular blanked out portions and cut lines 142, 144 separate end panels 52 from sidewalls 20 and also define upstanding tabs 54. A transverse score line 146 is formed at the juncture of cover panel 24 and exposed end panel 60, and also at the juncture of sidewalls 20 and end flaps 70. A score line 110 extends along the entire width of exposed end panel 60, between the cut lines 130. Score line 112, generally parallel to and spaced closely with respect to the aforementioned score line 110, also extends between cut lines 130, but is interrupted by cut lines 150 which define locking tabs 80.

Referring again to FIG. 2, rectangular portions are defined at the juncture of sidewalls 28 and flaps 56 by a series of score lines 152. Full cut lines 154 extend between the score lines 152 and provide passage for tabs 54 to extend therethrough with a close fit frictional engagement.

In addition to the irregular outlines formed at the major edges of blank 16, recesses 74 and 160 are formed. The recesses 160 form the inner pair of upstanding tabs 54 which are blocked from view in the perspective illustration of FIG. 1. The depth D of recess 74 directly controls the angular orientation of locking tabs 80 and, as can now be seen, can be easily adjusted during processing of the carton blank. The offset of interior edge 92 from the free edge 76 of end flaps 70 also determines the moment arm and resilient characteristics of locking tab 80. That is, the point of contact of interior edge 92 can be adjustably located between the hinge 84 and the locking edge 88 of the locking tab to alter the moment arm and resilient deflection characteristics of the locking tab, without affecting the aesthetic appearance of the carton. Thus, cartons constructed according to principles of the present invention can be readily adapted for a variety of sheet materials having different resilience properties.

According to other aspects of the present invention, no matter which angular offset for the locking tab is provided, and no matter where the point of contact of interior edge of the end flap is located with respect to the locking tab, the locking edge 88 of the locking tab will remain approximately constant, and hence the location of tabs 96 struck out from the carton bottom endwall need not be varied from one value of recess depth D to another.

In the preferred embodiment, of a carton constructed according to aspects of the present invention, additional lines of weakening have been provided in the carton cover and bottom adjacent one side thereof. The perforated lines, identified by the reference numeral 166 allow restricted access to the interior of a closed and locked carton, an advantageous feature to avoid spilling of the carton contents, while allowing incremental withdrawal from the closed carton.

Figure 8:
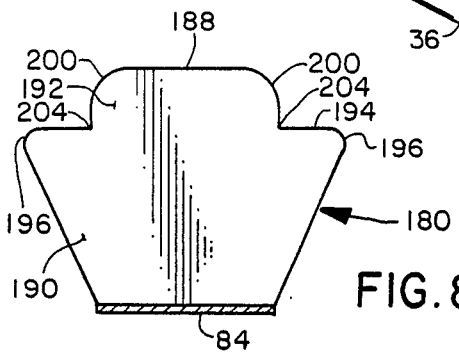

With reference to FIG. 8, an alternative embodiment of the locking tab will be described. As mentioned above, and as can be seen in FIG. 1, the locking tab 80 has a generally rectangular configuration with rounded upper corners, on either side of the locking edge 88. In some applications, it is desirable to limit the amount of insertion of the locking tab in the bottom endwall aperture, such as the recess or aperture 98 formed in the bottom outer endwall 14.

A locking tab 180 illustrated in FIG. 8 provides positive control against over-penetration of the locking tab in the bottom endwall. The locking tab 180, in contrast to the locking tab 80, has an overall keystone shape with a bottom trapezoidal portion 190, joined at its lower end by hinge 84 to the exposed cover end panel 60. In the preferred form of the alternative embodiment, the locking tab 180 is struck out from the interior flap 64, as described above for the locking tab 80. The same hinge 84, formed by a single fold line, is preferred to provide the angular offset, wedging, and other features described above.

The locking tab has an upper locking portion 192 of reduced size relative to the lower portion 190, and shoulders 194 extend in lateral directions between the upper and lower portions 192, 190 and blend the outer edges thereof together. Rounded corners 196, which are located at the joinder of the shoulders 194 to the bottom portion 190, could be replaced by sharp corners or corners of other configurations. The corners 200 at either end of the upper free end or locking edge 188 of the locking tab are preferred to facilitate a low resistance, snag free entry of the locking tab into the bottom endwall aperture 98. The rounded corners 200 may, however be replaced by corners of other configurations, particularly if the apertures 98 are oversized.

Operation of the carton locking is substantially as that described above, except that any over-insertion of the locking tab in the bottom endwall recess is limited as the shoulders 94 contact the locking edge 100 of endwall 36. Such over-insertion could occur, for example, upon the inadvertent application of force applied to the cover which might tend to open the carton, once the carton is closed and locked. Of course, over-insertion might otherwise result from attempts at unauthorized entry into a locked carton, and the locking tab 180 has been found to provide an enhanced strength, particulary as the shoulders are brought into contact with the bottom endwall 36 and the locking edge 100 is wedged at the corners 204, located at the inner ends of shoulders 194.

As described above, in the preferred embodiment, recesses 98 are provided by forming hinged tabs 96 in the bottom outer endwall 36. The inwardly and upwardly extending tabs may provide a guiding surface for the locking tab when inserted in the recess 98, in addition to the hinge 104 which joins the tabs 96 to endwall 36. The tab 96 could be eliminated if desired, particularly if the guiding contact contributed thereby is not required. If tab 96 should be eliminated, the pressure required for its inward deflection is no longer applied against the locking tab, which freely enters aperture 98, and in some applications this may be a desirable feature.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton assembly, comprising:

a cover member including an inner, hinge mounting end and an opposed outer end with a downwardly depending outer endwall the cover member further including an interior flap extending from the cover outer endwall;

a receptacle member interfittable with the cover member including an inner, hinge mounting end and an opposed outer end with an upstanding outer endwall;

hinge means joining the inner ends of the cover and receptacle members so as to bring the cover and receptacle member outer endwalls immediately adjacent one another when the cover and receptacle members are interfitted one in the other;

a lock tab struck out from the interior flap so as to be upwardly and inwardly extending from the cover outer endwall, said lock tab having an upper free end portion of reduced size extending from a lower portion of enlarged size with laterally extending shoulders between the upper and lower portions, engageable with the receptacle member outer endwall to restrict insertion of the lock tab in said recess;

a recess on the receptacle outer endwall for receiving at least a portion of the lock tab when the cover and receptacle members are interfitted; and aligning means associated with the cover member for aligning the lock tab for reception in the recess when the cover and receptacle members are interfitted.

2. A carton assembly, comprising:

a cover member including an inner, hinge mounting end and an opposed outer end with a downwardly depending outer endwall, a cover member further including an interior flap extending from the cover outer endwall;

a receptacle member interfittable with the cover member, including an inner, hinge mounting end and an opposed outer end with an upstanding outer endwall;

hinge means joining the inner ends of the cover and receptacle members so as to bring the cover and receptacle member outer endwalls immediately adjacent one another when the cover and receptacle members are interfitted one in the other;

a lock tab struck out from a portion of the interior flap so as to have a free end and so as to be upwardly and inwardly extending from the cover outer endwall;

a recess on the receptacle outer endwall for receiving at least a portion of the lock tab when the cover and receptacle members are interfitted;

aligning means associated with the cover member for aligning the lock tab for reception in the recess when the cover and receptacle members are interfitted; and a first hinge formed by a pair of spaced fold lines joining the interior flap to the cover outer endwall, a second hinge formed by a single fold line joining the lock tab to the cover outer endwall, so that the lock tab free end is offset from the portion of the interior flap from which it is struck out, with the lock tab being aligned in an upward and inward direction when contacting the interior flap.

3. A carton assembly, comprising:

a cover member including an inner, hinge mounting end and an opposed outer end with a downwardly depending outer endwall;

a receptacle member interfittable with the cover member including an inner, hinge mounting end and an opposed outer end with an upstanding outer endwall;

hinge means joining the inner ends of the cover and receptacle members so as to bring the cover and receptacle member outer endwalls laterally adjacent one another when the cover and receptacle members are interfitted one in the other;

a lock tab having an upper free edge, upwardly and inwardly extending from the cover outer endwall and hingedly connected thereto with lock tab hinge means;

a recess on the receptacle outer endwall for receiving at least a free end portion of the lock tab when the cover and receptacle members are interfitted;

aligning means associated with the cover member for aligning the lock tab for reception in the recess when the cover and receptacle members are interfitted, said aligning means including spacer means between the free end portion of said lock tab and said cover outer endwall and including an edge spaced from said lock tab hinge means for contacting said lock tab so as to space the lock tab from the cover outer endwall with an acute angle; and a hinged tab struck out from the receptacle member outer endwall so as to form a locking edge therein, with the struck out tab extending upwardly and inwardly so as to engage the lock tab when the lock tab is received in said recess, to align the upper free edge of the lock tab in abutting engagement with the locking edge of the receptacle member outer endwall.

4. A carton assembly, comprising:

a cover member including an inner, hinge mounting end and an opposed outer end with a downwardly depending outer endwall, said cover member further including an interior flap extending from the cover endwall;

a receptacle member interfittable with the cover member including an inner, hinge mounting end and an opposed outer end with an upstanding outer endwall;

hinge means joining the inner ends of the cover and receptacle members so as to bring the cover and receptacle member outer endwalls laterally adjacent one another when the cover and receptacle members are interfitted one in the other;

a lock tab struck out from a portion of the interior flap so as to have a free end, and so as to be upwardly and inwardly extending from the cover outer endwall and hingedly connected thereto with lock tab hinge means;

a recess on the receptacle outer endwall for receiving at least a free end portion of the lock tab when the cover and receptacle members are interfitted;

aligning means associated with the cover member for aligning the lock tab for reception in the recess when the cover and receptacle members are interfitted, said aligning means including spacer means between the free end portion of said lock tab and said cover outer endwall and including an edge spaced from said lock tab hinge means for contacting said lock tab so as to space the lock tab from the cover outer endwall with an acute angle; and the interior flap joined to the cover outer endwall with a hinge formed by a pair of spaced fold lines and the lock tab joined to the cover outer endwall with a hinge formed by a single fold line so that the lock tab free end is offset from the portion of the interior flap from which it is struck out, to align the lock tab in an upward and inward direction.

5. A carton assembly, comprising:

a cover member including an inner, hinge mounting end and an opposed outer end with a downwardly depending outer endwall;

a receptacle member interfittable with the cover member including an inner, hinge mounting end and an opposed outer end with an upstanding outer endwall;

hinge means joining the inner ends of the cover and receptacle members so as to bring the cover and receptacle member outer endwalls laterally adjacent one another when the cover and receptacle members are interfitted one in the other;

a lock tab having a smaller upper free end portion extending from a larger lower portion, the lock tab upwardly and inwardly extending from the cover outer endwall and hingedly connected thereto with lock tab hinge means;

a recess on the receptacle outer endwall for receiving at least a part of the free end portion of the lock tab when the cover and receptacle members are interfitted;

aligning means associated with the cover member for aligning the lock tab for reception in the recess when the cover and receptacle members are interfitted, said aligning means including spacer means between the free end portion of said lock tab and said cover outer endwall and including an edge spaced from said lock tab hinge means for contacting said lock tab so as to space the lock tab from the cover outer endwall with an acute angle; and said lock tab further having laterally extending shoulders between the upper and lower portions thereof, engageable with the receptacle member outer endwall to restrict insertion of the lock tab in said recess.

* * * * *